United States Patent [19]

Berggren

[11] 3,991,946

[45] Nov. 16, 1976

[54] MACHINE FOR PRODUCING WOOD SHAVINGS FROM CHIPS

[75] Inventor: Torsten Lennart Berggren, Nassjo, Sweden

[73] Assignee: Cellwood Machinery AB, Nassjo, Sweden

[22] Filed: Sept. 2, 1975

[21] Appl. No.: 609,776

[30] Foreign Application Priority Data

Sept. 5, 1974 Sweden ..... 7411249

[52] U.S. Cl. ..... 241/93; 144/176; 144/230; 241/280

[51] Int. Cl.[2] ..... B02C 18/14

[58] Field of Search ..... 241/93, 273, 280, 281; 144/172, 176, 230

[56] References Cited

UNITED STATES PATENTS

| | | | |
|---|---|---|---|
| 1,518,583 | 12/1924 | Jones | 241/281 |
| 1,541,521 | 6/1925 | Nenzel | 241/281 |
| 2,297,438 | 9/1942 | Stehr | 241/281 X |
| 2,849,038 | 8/1958 | Clark | 144/176 |
| 3,237,663 | 3/1966 | Kirsten | 144/176 |
| 3,814,154 | 6/1974 | Nicholson | 241/93 X |

*Primary Examiner*—Granville Y. Custer, Jr.
*Assistant Examiner*—Howard N. Goldberg
*Attorney, Agent, or Firm*—Flynn & Frishauf

[57] ABSTRACT

A machine for cutting wood chips to shavings comprises a rotatable drum having circumferentially spaced cutting members connected to a feed passageway. The latter extends along a substantial portion of the length of the drum and houses feed screws forcing the chips into contact with the cutting members. The drum is surrounded by a housing with a widened portion defining a wedge-shaped cutting chamber. The formed shavings pass inside the drum in the longitudinal direction thereof to the outlet of the machine.

8 Claims, 2 Drawing Figures

MACHINE FOR PRODUCING WOOD SHAVINGS FROM CHIPS

This invention relates to a machine for cutting chips to shavings to be used as starting material for the manufacture of, for example, particle boards and similar products. In another typical field of application the chips are digested in a chemical or semi-chemical way for the manufacture of paper pulp. The machine comprises a rotary drum with a plurality of cutting members distributed along its periphery and a feed passageway connected to the drum.

For the last several years there has been a shortage of mature forests. Consequently, there is a shortage of cellulose fibers and chip material for the manufacture of the products mentioned above. For this reason, among others, attention has been focused on wood resources not utilized heretofore, even in tropical countries, for example in Africa and South America. When tree species received from such regions are worked mechanically, two special problems arise. One problem is that the forest stand is dominated by broad-leaved trees, i.e. hardwood, and the second problem is the number of species, which, even within a very limited area, regularly is very great, so that the starting material to be worked is not homogenous, but rather a mixture of several different tree species.

Even in cases when one does not meet the aforementioned special problems caused by mixed tree species, special difficulties arise when only hard tree species are to be worked. For example, such hard tree species cannot at all or only with great difficulty be digested to pulp when the starting material consists of chips. In such cases, therefore, the mechanical working must be continued by cutting the chips to shavings.

Thus, there is a great demand for machinery equipment with the capability of cutting shavings from hard tree species whether they are to be used in particle boards or in the pulp industry. In order to try to avoid that at the manufacture of pulp two mechanic working operations must be carried out, viz. first chipping and thereafter cutting to shavings, it was proposed to cut shavings directly from logs. It was found, however, that the cutters of the cutting machines then have such a short service life that it would be necessary to preheat the starting material. This is for several reasons entirely unrealistic when working solid logs. It remains only to state that with the present state of art the production of shavings still must take place by using chips.

SUMMARY OF THE INVENTION

The above discussion concerning the shortcomings of the machines now available apparently can be summarized in three requirements. Firstly, the machine must cut shavings from chips - not directly from logs. Secondly, the chip pieces must be forcibly fed into the machine and, thirdly, the cutting chamber of the machine must be so designed that the forced feed does not result in blocking. All these conditions have been satisfied in a machine according to the present invention, which is characterized in that the feed passageway connected to the drum extends along a substantial portion of the drum, in the direction of its longitudinal axis, and includes plurality of feed screws for forcibly feeding in the chips substantially radially relative to the drum; in that gaps are provided in the drum wall adjacent the cutters for permitting the shavings to be introduced into the drum interior for further conveyance in axial direction to the machine outlet; and that the drum is enclosed by a cylindrical housing, which downstream of the feed passageway, in the rotation direction of the drum, is provided with a widened portion, which portion between itself and the drum defines a cutting chamber of wedge-shaped cross-section.

In view of their feed by screws, the chip pieces can be imagined to arrive at the drum oriented in all possible directions. However, tests and experiments have clearly proved that the majority of the chip pieces during the feed movement are given such positions that they meet the drum with their flat sides, i.e. the cutting takes place in the direction of the fibres. The remaining relatively few chip pieces, which are not delivered with such orientation from the feed screw, are, however, also brought into desired positions prior to their arrival at the cutters, owing to the fact that the wedge-shaped cutting chamber formed by the widened portion located downstream of the feed means guides the chips into the cutting zone. When, for example, a chip piece stands on end in the feed passageway beneath the screw, the cutters first meet this chip piece perpendicularly to the fibre direction. Since the force required for cutting in this direction is substantially greater than the force required for cutting the chip piece in the fibre direction, the cutters have a tendency to put down the chip piece into the right position before it is fed into the cutting zone where the cutting proper takes place.

DETAILED DESCRIPTION OF ILLUSTRATED EMBODIMENT

Figure 1:
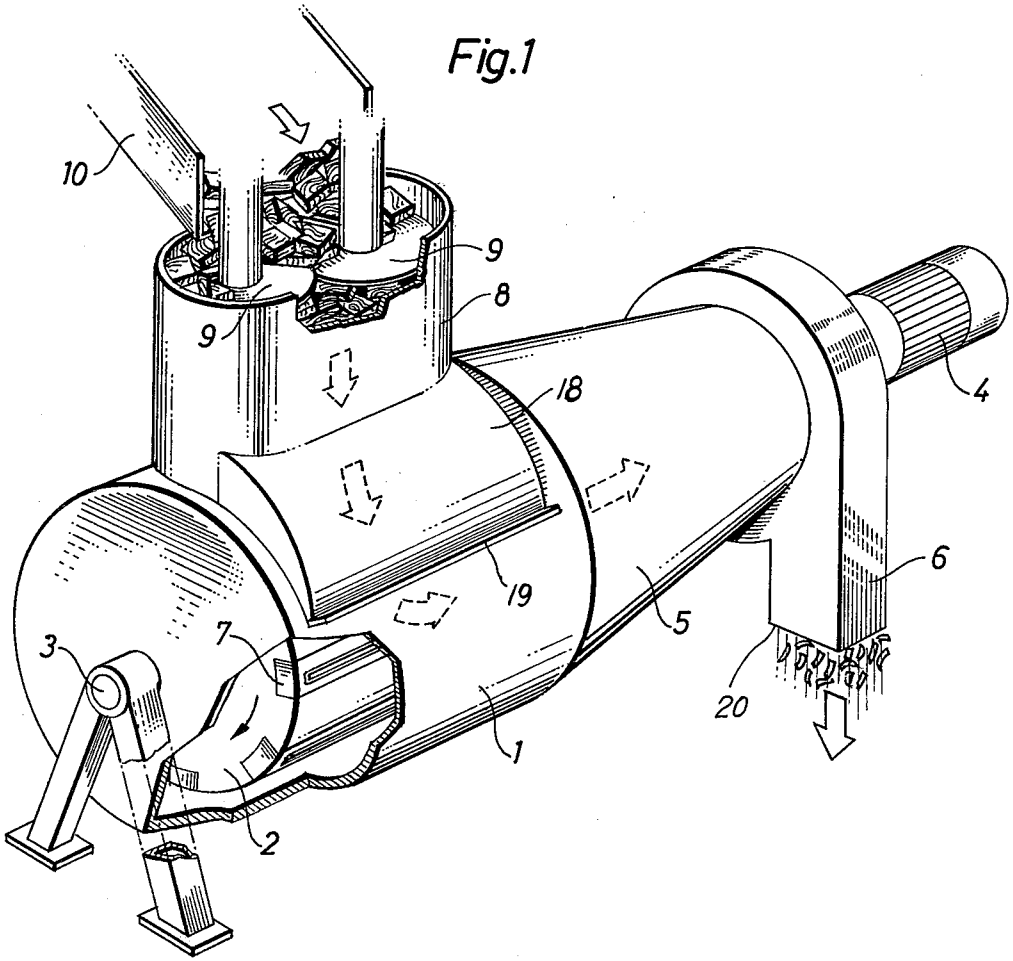
FIG. 1 is a perspective view partly in section of a machine designed according to the invention.

The machine shown in FIG. 1 comprises a housing 1 with one cylindrical and one conical portion. Within the cylindrical portion a cutter drum 2 is located, the horizontal rotary shaft 3 of which is driven by a motor 4. The conical portion 5 of the housing constitutes an outlet from the cutting chamber which, consequently, is located between the cylindrical housing portion and the drum 2. Shavings cut in the cutting chamber are sucked by means of a fan to the outlet of the machine which is formed by the outlet 20 from the casing 6 of the fan. In the periphery of the drum 2 longitudinal grooves are provided, each including a tool set 7. The construction of said tool set is more clearly seen in FIG. 2.

Figure 2:
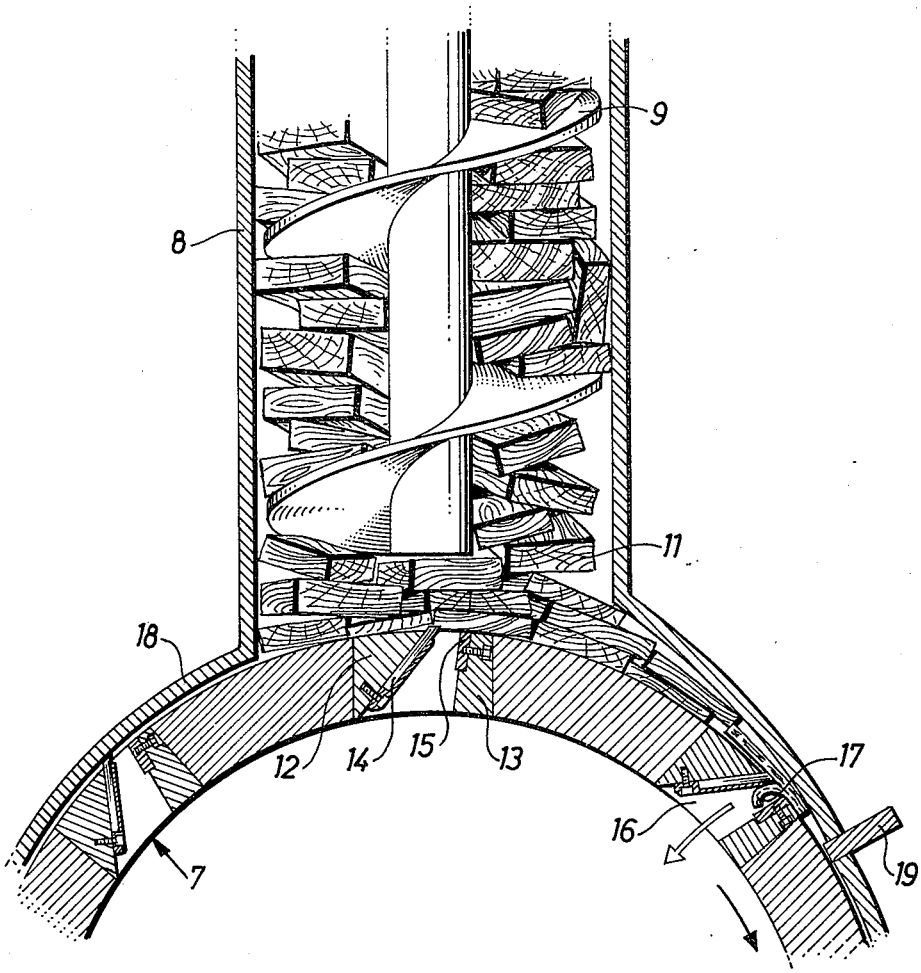
FIG. 2 is on an enlarged scale an axial section through a portion of a cutter drum and a feed passageway located above the same.

A feed passageway 8 is connected to the upper surface of the cylindrical housing 1. Two feed screws 9 are disposed within feed passageway 8 and to which the chips 11 are supplied via a chute 10. The drive means for the feed screws are not shown for reason of better clarity. The feed screws 9 cause the supplied chip pieces 11 to move in a downward direction and, thus, feed them forcibly in a radial direction down to the drum 2. FIG. 2 shows in detail the nature of the tool sets 7 which have a straightedge shape supported by the drum. It is, thus, apparent that each such straightedge tool has two lateral pieces 12 and 13, of which the firstmentioned one carries a cutter 14 and the lastmentioned one a dolly 15. The two tools 14 and 15 are inserted into surfaces of the respective lateral pieces 12 and 13 facing toward each other and are so inclined that the desired cutting conditions are obtained. Between said two lateral surfaces a gap 16 is formed, through which shavings 17 cut off from the chips can pass into the drum interior for further conveyance in the axial direction through the cone 5 and fan casing 6 to the machine outlet 20.

FIG. 2 also illustrates that the majority of chip pieces after their delivery from the screws 10 meet the drum 2 with their flat sides facing toward the same. In the transition between the housing 1 and the front wall of the feed passageway 8, downstream of the feed screws, a widened sloping portion 18 is provided which, together with the drum z, defines a cutting chamber of wedge-shaped cross-section. The object of this arrangement is to guide the chip pieces in the manner described above rightly oriented all the way to the place where the cutting to shavings takes place. This place is defined in the rotation direction of the drum by a counter-cutter 19, which extends along a generatrix with the drum, and the radial position of which preferably can be adjusted with respect to the desired thickness of the shavings.

When working the invention, many variations of the embodiment described above by way of example can be imagined. It is particularly to be pointed out that the term "drum" has been used in its functional sense in order to define one or more rotary members with cutters disposed along the periphery. The drum need not be a coherent unit, but can comprise a plurality of parallel rings. The feed passageway can be connected in a way different from that described, and the feed means need not necessarily be screws although screws have brought about especially good results.

What is claimed is:

1. A machine for cutting chips (11) to shavings for use as starting material in the manufacture of, for example, particle boards and similar products, comprising:

a rotatable drum (2) having a hollow interior and a plurality of cutting members (7) distributed along its periphery;

a cylindrical housing (1) enclosing said drum (2);

an outlet (20) for shavings in communication with the hollow interior of said drum;

a feed passageway (8) extending along a substantial portion of said drum in the direction of the longitudinal axis thereof;

a plurality of feed screws (9) in said feed passageway (8) to forcibly feed said chips (11) substantially radially relative to said drum (2);

said drum having gaps (16) in the wall thereof adjacent said cutting members (7) to permit shavings cut by said cutting members (7) to pass through the drum wall and into the hollow drum interior for conveyance in the axial direction of said drum to said outlet (20); and said housing (1) having a widened portion (18) downstream of said feed passageway (8) in the direction of rotation of said drum (2), said widened portion (18) extending gradually further away from said drum in the direction toward said feed passageway, said widened portion (18) defining between itself and said drum (2) a generally wedge-shaped cutting chamber.

2. A machine according to claim 1 further comprising a counter-cutter (19) extending along a generatrix of said widened portion (18) with said drum (2), said counter-cutter defining the end portion, in the direction of rotation of said drum, of said generally wedge-shaped cutting chamber.

3. A machine according to claim 1 wherein said cutting members (7) extend axially of said rotatable drum (2) and are circumferentially spaced about said rotatable drum.

4. A machine according to claim 3 wherein said cutting members (7) each include a cutter (14) protruding from the outer surface of said drum (2).

5. A machine according to claim 1 wherein said cutting members (7) each include a cutter (14) protruding from the outer surface of said drum (2).

6. A machine according to claim 1 further comprising a generally cone-shaped member (5) coupled to said housing (1) and leading to said outlet (20) of said machine.

7. A machine according to claim 6 further comprising a fan (6) coupled to the smaller end of said cone-shaped member (5) for conveying shavings from the interior of said drum (2) to said outlet (20) of said machine.

8. A machine according to claim 1 further comprising a fan (6) coupled to said housing (1) for conveying shavings from the interior of said drum (2) to said outlet (20) of said machine.

* * * * *

UNITED STATES PATENT OFFICE

CERTIFICATE OF CORRECTION

Patent No. 3,991,946 Dated November 16, 1976

Inventor(s) Torsten Lennart BERGGREN

It is certified that error appears in the above-identified patent and that said Letters Patent are hereby corrected as shown below:

IN THE ABSTRACT:

line 3, after "spaced cutting members" insert --and--.

Signed and Sealed this

First Day of February 1977

[SEAL]

*Attest:*

RUTH C. MASON
*Attesting Officer*

C. MARSHALL DANN
*Commissioner of Patents and Trademarks*